US006555963B1

(12) United States Patent
Snijkers-Hendrickx et al.

(10) Patent No.: US 6,555,963 B1
(45) Date of Patent: Apr. 29, 2003

(54) FLUORESCENT LAMP HAVING TRANSPARENT LAYER WITH LOW MERCURY CONSUMPTION

(75) Inventors: Ingrid J. M. Snijkers-Hendrickx, Eindhoven (NL); Volker D. Hildenbrand, Eindhoven (NL); Johannes H. Roes, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/430,786

(22) Filed: Nov. 9, 1999

(30) Foreign Application Priority Data

Nov. 12, 1998 (EP) ..... 98203824

(51) Int. Cl.[7] ..... H01J 1/62; H01J 63/04

(52) U.S. Cl. ..... 313/638; 313/486; 313/487; 313/489

(58) Field of Search ..... 313/485, 486, 313/487, 638, 489

(56) References Cited

U.S. PATENT DOCUMENTS 4,069,441 A * 1/1978 Wanmaker et al. ..... 313/487
4,544,997 A 10/1985 Seuter et al. ..... 362/263
4,803,401 A 2/1989 Matsuno et al. ..... 313/489
5,170,095 A * 12/1992 Bardos et al. ..... 313/486
5,402,036 A * 3/1995 Ito ..... 313/487
5,417,886 A * 5/1995 Tateiwa et al. ..... 106/287.27
5,753,999 A * 5/1998 Roozekrans et al. ..... 313/489
5,869,927 A * 2/1999 Matsuo et al. ..... 313/485
5,898,265 A * 4/1999 Woodward et al. ..... 313/486

FOREIGN PATENT DOCUMENTS

JP 02040854 * 2/1990 ..... H01J/61/35
JP 10040862 * 2/1998 ..... H01J/61/06

* cited by examiner

*Primary Examiner*—Ashok Patel
*Assistant Examiner*—Sikha Roy
(74) *Attorney, Agent, or Firm*—Dicran Halajian

(57) ABSTRACT

Low-pressure mercury vapor discharge lamp provided with a discharge vessel (10). The discharge vessel (10) encloses a discharge space (11), provided with a filling of mercury and a rare gas, in a gastight manner. At least a part of an inner surface of the discharge vessel (10) is provided with a transparent layer (16) comprising an oxide of scandium, yttrium, or a rare earth metal (lanthanum, cerium, gadolinium, ytterbium, and/or lutetium). The discharge lamp is characterized in that the transparent layer (16) comprises a borate or a phosphate of an alkaline earth metal and/or of scandium, yttrium or a further rare earth metal. Preferably, the alkaline earth metal is calcium, strontium and/or barium. The further rare earth metal is preferably lanthanum, cerium and/or gadolinium. The oxide is preferably $Y_2O_3$ or $Gd_2O_3$. Preferably, the transparent layer (16) has a thickness of between 5 nm and 200 nm. A luminescent layer (17) is preferably provided on top of the transparent layer in the discharge vessel. The lamp according to the invention has a comparatively low mercury consumption.

11 Claims, 3 Drawing Sheets

FLUORESCENT LAMP HAVING TRANSPARENT LAYER WITH LOW MERCURY CONSUMPTION

BACKGROUND OF THE INVENTION

The invention relates to a low-pressure mercury vapor discharge lamp, having a discharge vessel enclosing, in a gastight manner, a discharge space provided with a filling of mercury and a rare gas, at least a part of an inner wall of the discharge vessel having a, transparent layer comprising an oxide of scandium, yttrium or a rare earth metal.

In mercury vapor discharge lamps, mercury constitutes the primary component for the (efficient) generation of ultraviolet (UV) light. A luminescent layer comprising a luminescent material (for example, a fluorescent powder) may be present on an inner wall of the discharge vessel so as to convert UV to other wavelengths, for example, to UV-B and UV-A for tanning purposes (sun panel lamps) or to visible radiation for general illumination purposes. Such discharge lamps are therefore also referred to as fluorescent lamps. The discharge vessel of low-pressure mercury vapor discharge lamps is usually circular and comprises both elongate and compact embodiments. Generally, the tubular discharge vessel of compact fluorescent lamps comprises a collection of relatively short straight parts having a relatively small diameter, which straight parts are connected together by means of bridge parts or via bent parts. Compact fluorescent lamps are usually provided with an (integrated) lamp cap.

It is known that measures are taken in low-pressure mercury vapor discharge lamps to inhibit blackening of parts of the inner wall of the discharge vessel, which parts are in contact with the discharge which, during operation of the lamp, is present in the discharge space. Such a blackening, which is established by interaction of mercury and glass, is undesirable and does not only give rise to a lower light output but also gives the lamp an unaesthetic appearance, particularly because the blackening occurs irregularly, for example, in the form of dark stains or dots. By using the oxides mentioned in the opening paragraph, blackening and discoloration of the inner wall of the discharge vessel is reduced to a minimum.

A low-pressure mercury vapor discharge lamp of the type described in the opening paragraph is known from U.S. Pat. No. 4,544,997. In the known lamp the oxides are provided as a thin layer on the inner wall of the discharge vessel. The known transparent layers are colorless, hardly absorb UV radiation or visible light and satisfy the requirements of light and radiation transmissivity.

A drawback of the use of the known low-pressure mercury vapor discharge lamp is that the consumption of mercury is still relatively high. As a result, a relatively large amount of mercury is necessary for the known lamp so as to realize a sufficiently long lifetime. In the case of injudicious processing after the end of the lifetime, this is detrimental to the environment.

SUMMARY OF THE INVENTION

The low-pressure mercury vapor discharge lamp according to the invention has a transparent layer which further comprises a borate and/or a phosphate of an alkaline earth metal and/or of scandium, yttrium or a further rare earth metal.

Layers comprising both the oxides mentioned in the opening paragraph and said borates and/or phosphates in accordance with the inventive measure, appear to be very well resistant to the effect of the mercury-rare gas atmosphere which, in operation, prevails in the discharge vessel of a low-pressure mercury vapor discharge lamp. It has surprisingly been found that the mercury consumption of low-pressure mercury vapor discharge lamps provided with a transparent layer according to the invention is considerably lower than in transparent layers of the known low-pressure mercury vapor discharge lamps. By way of example, low-pressure mercury vapor discharge lamps provided with a transparent layer according to the invention were compared with known low-pressure mercury vapor discharge lamps provided with a transparent layer comprising an oxide. After several thousand operating hours, an at least substantially twice smaller mercury content was found in transparent layers according to the invention as compared with the known transparent layers. Said effect occurs both in straight parts and in bent parts of (tubular) discharge vessels of low-pressure mercury vapor discharge lamps. Bent lamp parts are used, for example, in hook-shaped low-pressure mercury vapor discharge lamps. The measure according to the invention is notably suitable for (compact) fluorescent lamps having bent lamp parts.

The transparent layers in the low-pressure mercury vapor discharge lamp according to the invention further satisfy the requirements of light and radiation transmissivity and can be easily provided as very thin, closed and homogeneous transparent layers on an inner wall of a discharge vessel of a low-pressure mercury vapor discharge lamp. This is effected, for example, by rinsing the discharge vessel with a solution of a mixture of suitable metal-organic compounds (for example, acetonates or acetates, for example, scandium acetate, yttrium acetate, lanthanum acetate or gadolinium acetate mixed with calcium acetate, strontium acetate or barium acetate) or of boric acid or of phosphoric acid diluted in water, while the desired layer is obtained after drying and sintering.

An additional advantage of a transparent layer according to the invention is that such layers have a relatively high reflectivity in the wavelength range around 254 nm (in the discharge vessel, mercury generates, inter alia, resonance radiation at a wavelength of 254 nm). Given the refractive index of the transparent layer, which is relatively high with respect to the refractive index of the inner wall of the discharge vessel, such a layer thickness is preferably chosen that the reflectivity at said wavelength is maximal. By using such transparent layers, the initial light output of low-pressure mercury vapor discharge lamps is increased.

In a preferred embodiment, the transparent layer comprises a borate and/or a phosphate of calcium, strontium and/or barium. Such a transparent layer has a relatively high coefficient of transmission for visible light. Moreover, low-pressure mercury vapor discharge lamps with a transparent layer comprising calcium borate, strontium borate or barium borate or calcium phosphate, strontium phosphate or barium phosphate have a good maintenance.

In a further preferred embodiment of the low-pressure mercury vapor discharge lamp according to the invention, the transparent layer comprises a borate and/or a phosphate of lanthanum, cerium and/or gadolinium. Such a transparent layer has a relatively high coefficient of transmission for ultraviolet radiation and visible light. It has further been found that a transparent layer comprising lanthanum borate or gadolinium borate or comprising cerium phosphate or gadolinium phosphate has a good adhesion with the inner wall of the discharge vessel. Moreover, the layer can be provided in a relatively simple manner (for example, with lanthanum acetate, cerium acetate or gadolinium acetate mixed with boric acid or diluted phosphoric acid), which has a cost-saving effect, notably in a mass manufacturing process for low-pressure mercury vapor discharge lamps.

An additional advantage of the use in low-pressure mercury vapor discharge lamps of a transparent layer comprising a borate and/or a phosphate of scandium, yttrium, lanthanum, cerium arid/or gadolinium is that such layers have a relatively high reflectivity in the wavelength range around 254 nm. By using such high-refractive transparent layers and by optimizing the layer thickness of such layers, a low-pressure mercury vapor discharge lamp having an increased initial light output is obtained. Such layers may be used to particular advantage in, for example, low-pressure mercury vapor discharge lamps for radiation purposes (referred to as germicide lamps).

The transparent layer in a low-pressure mercury vapor discharge lamp according to the invention preferably comprises an oxide of yttrium and/or gadolinium. Such a transparent layer has a relatively high coefficient of transmission for ultraviolet radiation and visible light. It has further been found that a layer comprising these oxides is little hygroscopic and has a good adhesion with the inner wall of the discharge vessel. Moreover, the layer can be provided in a relatively easy manner (for example, with yttrium acetate or gadolinium acetate), which has a cost-saving effect.

In practical embodiments of the low-pressure mercury vapor discharge lamp, the transparent layer has a thickness of approximately 5 nm to approximately 200 nm. At a layer thickness of more than 200 nm, there is a too large absorption of the radiation generated in the discharge space. At a layer thickness of less than 5 nm, there is interaction between the discharge and the wall of the discharge vessel. A layer thickness of at least substantially 90 nm is particularly suitable. At such a layer thickness, the transparent layer has a relatively high reflectivity in the wavelength range around 254 nm.

According to a further preferred embodiment one side of the transparent layer facing the discharge space is provided with a layer of a luminescent material. An advantage of the use in low-pressure mercury vapor discharge lamps of a transparent layer according to the invention is that the luminescent layer comprising a luminescent material (for example, a fluorescent powder) has a considerably better adhesion with such a transparent layer than with a transparent layer of the known low-pressure mercury vapor discharge lamp.

These and other aspects of the invention are apparent from and will be elucidated with reference to the embodiments described hereinafter.

BRIEF DESCRIPTION OF THE DRAWINGS

The Figures are purely diagrammatic and not to scale. Notably, some dimensions are shown in a strongly exaggerated form for the sake of clarity. Similar components in the Figures are denoted as much as possible by the same reference numerals.

DETAILED DESCRIPTION OF THE PREFERRED EMBODIMENTS

Figure 1A:
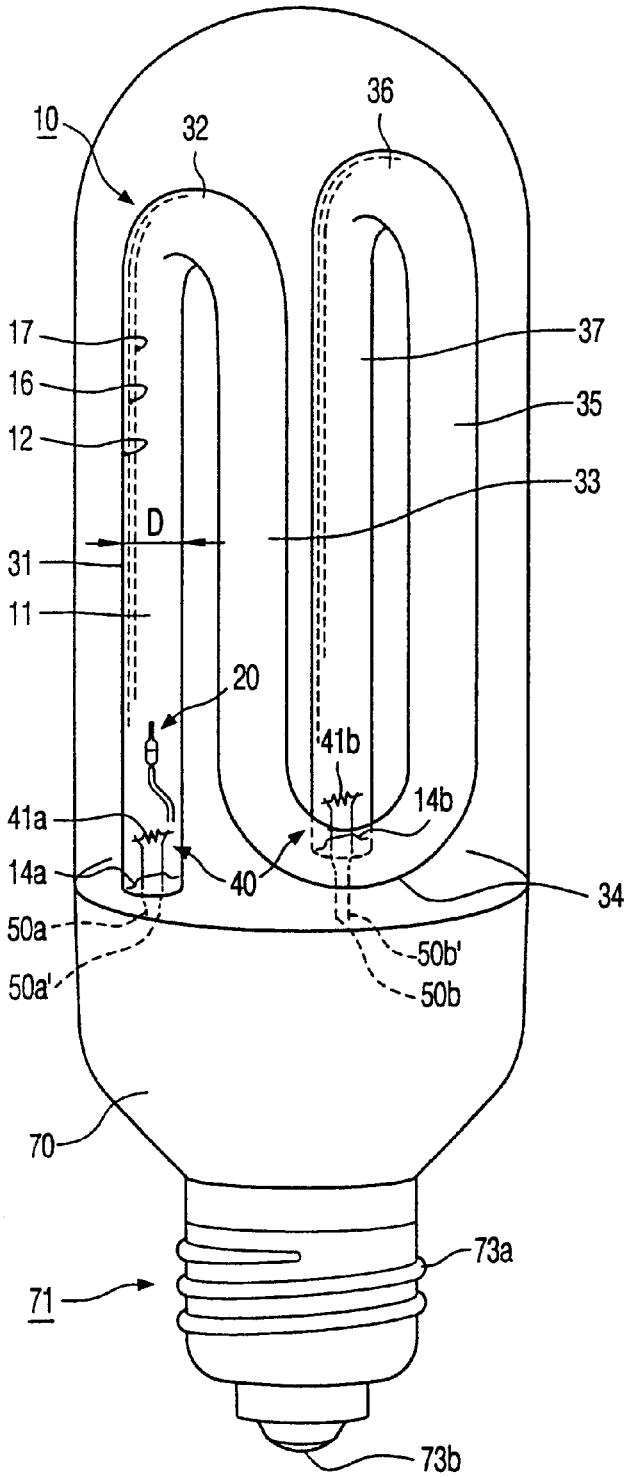
FIG. 1A shows an embodiment in an elevational view of the low-pressure mercury vapor discharge lamp according to the invention.
Figure 1B:
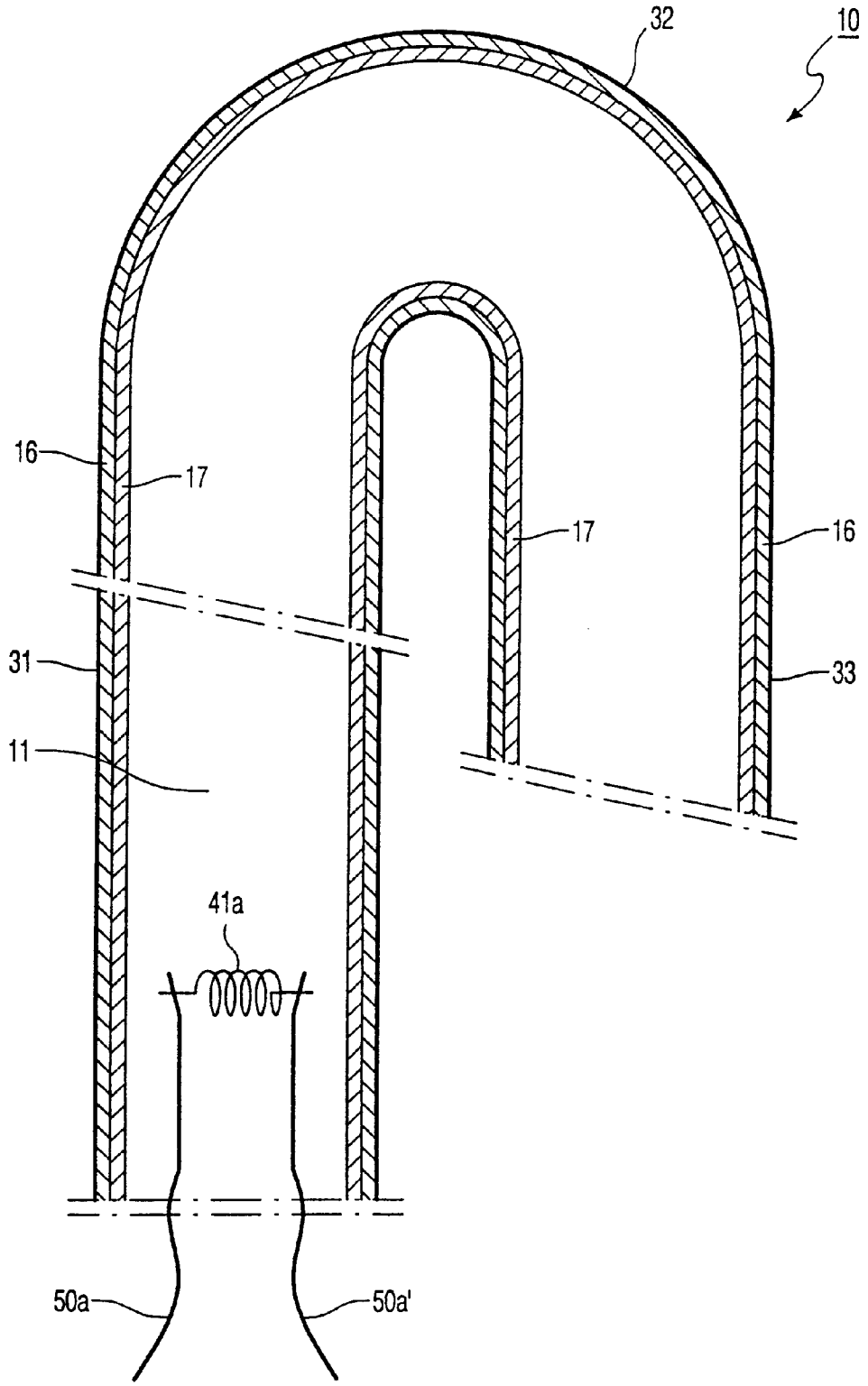
FIG. 1B is a cross-section of a detail of the low-pressure mercury vapor discharge lamp as shown in FIG. 1A.

FIG. 1A shows a low-pressure mercury vapor discharge lamp provided with a radiation-transmissive discharge vessel 10 enclosing, in a gastight manner, a discharge space 11 having a volume of approximately 30 $cm^3$. The discharge vessel 10 is a (chalk) glass tube having an at least substantially circular cross-section with an (effective) internal diameter D of approximately 10 mm. The tube is bent in the form of a hook and, in this embodiment, it has four straight parts 31, 33, 35 and 37 and three arcuate parts 32, 34 and 36. FIG. 1B is a cross-section of a detail of the low-pressure mercury vapor discharge lamp as shown in FIG. 1A. The discharge vessel 10 is provided on an internal surface 12 with a transparent layer 16 according to the invention and with a luminescent layer 17. The discharge vessel 10 is supported by a housing 70 which also supports a lamp cap 71. The discharge space 11 not only comprises mercury but also a rare gas, argon in this embodiment. In this embodiment, not only the discharge space 11 comprises mercury, but mercury is also present in a vapor-pressure control member 20, referred to as amalgam, in the embodiment 50 mg of an amalgam of 3% by weight of Hg with an alloy of, for example bismuth-tin or bismuth-tin-lead. Means 40 for maintaining a discharge are constituted by an electrode pair 41*a;* 41*b* arranged in the discharge space 11. The electrode pair 41*a;* 41*b* is a winding of tungsten coated with an electron-emissive material, here a mixture of barium oxide, calcium oxide and strontium oxide. Each electrode 41*a;* 41*b* is supported by an (indented) end portion 14*a;* 14*b* of the discharge vessel 10. Current supply conductors 50*a,* 50*a*'; 50*b,* 50*b*' exit from the electrode pair 41*a,* 41*b* through the end portions 14*a;* 14*b* of the discharge vessel 10 to the exterior. The current supply conductors 50*a,* 50*a*'; 50*b,* 50*b*' are connected to a power supply (not shown) which is incorporated in the housing 70 and is electrically connected to known electric and mechanic contacts 73*a,* 73*b* on the lamp cap 71.

Figure 2:
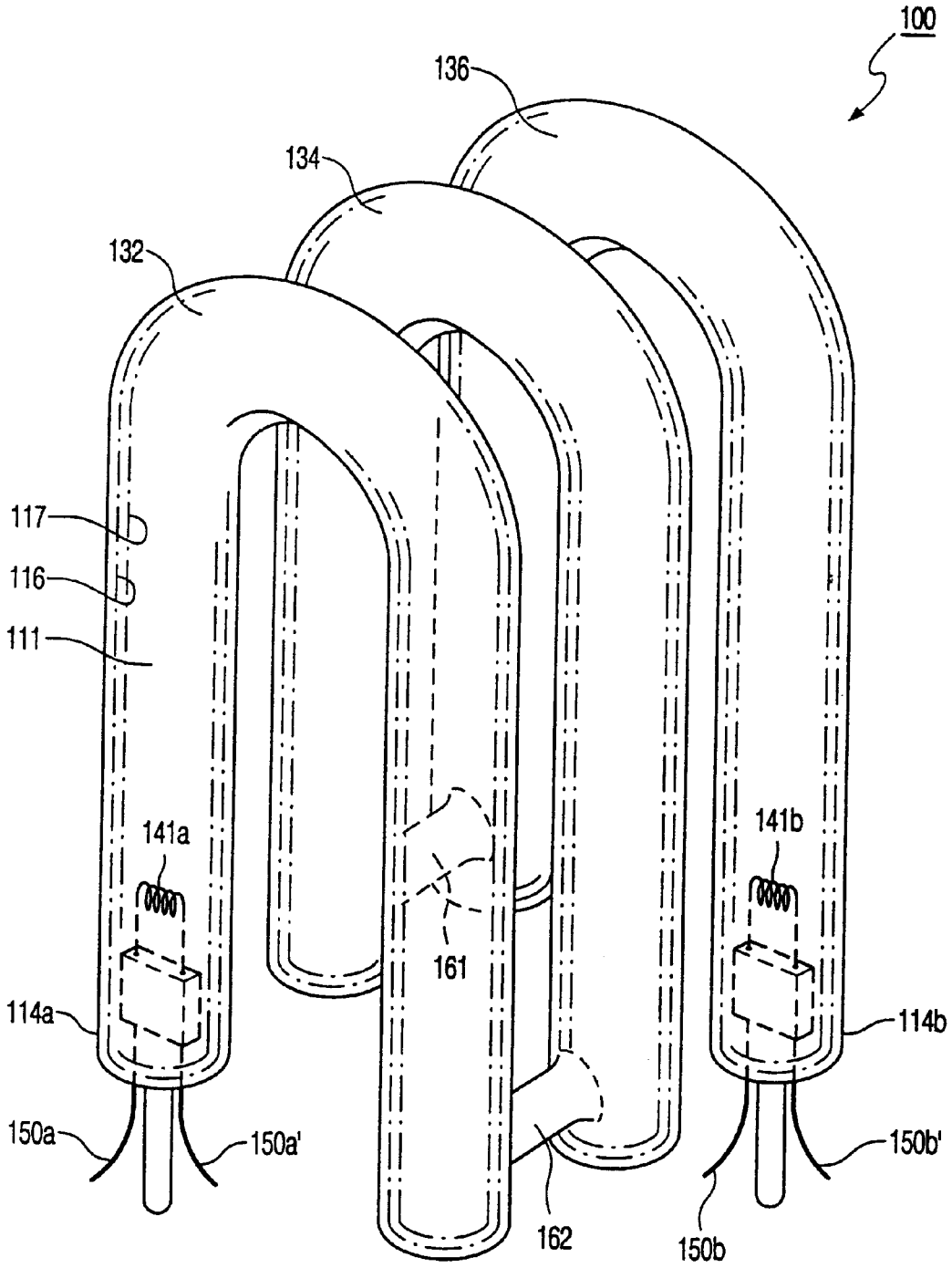
FIG. 2 shows an alternative embodiment in an elevational view of the low-pressure mercury vapor discharge lamp according to the invention.

FIG. 2 shows an alternative embodiment of a low-pressure mercury vapor discharge lamp according to the invention, which is provided with a discharge vessel 100 which encloses, in a gastight manner, a discharge space 111 comprising mercury and a rare gas. In this case, the discharge vessel comprises a mixture of 75% by volume of argon and 25% by volume of neon with a filling pressure of 400 Pa. The discharge vessel 100 is constituted by a light-transmissive tubular portion of chalk glass having three U-shaped segments 132, 134, 136 with an overall length of approximately 46 cm and an internal diameter of approximately 10 mm, and which is sealed by end portions 114A; 114B. The segments 132, 134, 136 are interconnected by channels 161, 162. An internal surface of the tubular portion is provided with a transparent layer 116 and a luminescent layer 117. The discharge vessel 10 has a volume V of approximately 36 $cm^3$. Current supply conductors 150*a,* 150*a*'; 150*b,* 150*b*' pass through each end portion 114*a;* 114*b* to a respective one of the electrodes 141*a;* 141*b* arranged in the discharge space 111.

In one embodiment of the low-pressure mercury vapor discharge lamp, various concentrations of an $Me(Ac)_2$ solution, in which Me=Sr or Ba, and $H_3BO_3$ were added to solutions comprising various concentrations of $Y(Ac)_3$ (yttrium acetate) for manufacturing a transparent layer according to the invention. The molar ratio between $Me(Ac)_2$ and $H_3BO_3$ was maintained constant. For the purpose of comparison, an 1.25% by weight of $Y(Ac)_3$ was also prepared. After rinsing and drying, the tubular discharge vessels were provided with a coating by passing an excess of the afore-mentioned solutions through the vessels. After coating, the discharge vessels were dried in air at a temperature of approximately 70° C. Subsequently, the discharge vessels were provided with a luminescent coating comprising three known phosphates, namely a green-luminescing material with terbium-activated cerium magnesium aluminate, a blue-luminescing material with bivalent europium-activated barium magnesium aluminate, and a red-luminescing material with trivalent europium-activated yttrium oxide. After coating, the discharge vessels were bent in the known hook shape with straight parts 31, 33, 35, 37 and arcuate parts 32, 34, 36 (see FIG. 1A). A number of discharge vessels was subsequently assembled to low-pressure mercury vapor discharge lamps in the customary manner.

The adhesion of the luminescent material to the transparent layer of a number of the discharge vessels thus manufactured was examined, using a test referred to as "clapper test". The result is shown in Table I.

TABLE I

Phosphor adhesion in discharge vessels (SL 18 W) with and without a transparent layer.

| | $Y(Ac)_3$ % by weight | $Sr(Ac)_2$ (mol) | $H_3BO_3$ (mol) | "powder-off" |
|---|---|---|---|---|
| 1 | — | — | — | 1 |
| 2 | 1.25 | — | — | 5 |
| 3 | 1.25 | 0.028 | 0.11 | 0 |
| 4 | 2.5 | 0.028 | 0.11 | 1 |

The magnitude "powder-off" mentioned in column 5 of Table I comprises a scale ranging from 0="no powder-off" (eminent adhesion) to 10="all powder-off" (no adhesion). Row 1 shows the result of a luminescent layer provided directly on the inner wall of the discharge vessel. Row 2 shows the result of a transparent layer of the known discharge lamp. Rows 3 and 4 of Table I show the results of two transparent layers (different $Y(Ac)_3$ concentrations) of low-pressure mercury vapor discharge lamps according to the invention. Table I shows that the adhesion of the luminescent layer to a transparent layer in accordance with the inventive measure is comparable with or better than that of an uncoated discharge lamp and is considerably better than the adhesion of the luminescent layer to a transparent layer of the known discharge lamp.

Table II shows the results of maintenance tests.

TABLE II

Maintenance of discharge lamps (SL 18 W) with and without a transparent layer.

| | Maintenance | | | | | |
|---|---|---|---|---|---|---|
| | $Y(Ac)_3$ % by weight | $Sr(Ac)_2$ (mol) | $H_3BO_3$ (mol) | Initial Lumens 100 hrs | 100 hrs (%) | 1000 hrs (%) |
| 1 | — | — | — | 813 | 100 | 91.6 |
| 2 | 1.25 | — | — | 848 | 100 | 91.6 |
| 3 | 2.5 | 0.056 | 0.22 | 764 | 100 | 92.4 |
| 4 | 3.75 | 0.028 | 0.11 | 812 | 100 | 94.2 |

Table II shows that the maintenance of low-pressure mercury vapor discharge lamps provided with a transparent layer according to the invention is improved with respect to the known discharge lamp and with respect to the uncoated discharge lamp. Comparable tests, in which $Ba(Ac)_2$ instead of $Sr(Ac)_2$ was used as a precursor for the transparent layer show that the maintenance of these discharge lamps is comparable with that of the known discharge lamp, but the discharge lamps having a Ba addition according to the invention have an improved adhesion of the luminescent layer to the transparent layer.

Table III shows, by way of example, the result of the mercury consumption (expressed in $\mu$g Hg) of various low-pressure mercury vapor discharge lamps. The example of Table III relates to a low-pressure mercury vapor discharge lamp as shown in FIGS. 1A and 1B with a transparent layer comprising Sr, in which the tubular discharge vessel is bent in the form of a hook and has four straight parts 31, 33, 35 and 37 and three arcuate parts 32, 34 and 36. The Figures mentioned in the first column of Table III correspond to the reference numerals of the relevant straight and bent parts. The mercury contents (in $\mu$g Hg) of the transparent layer were (destructively) measured on six lamps after several thousand operating hours. The values found for the mercury consumption were averaged. Table III does not state any results of measurements of the mercury consumption in the ambience of the electrode and/amalgam.

TABLE III

Mercury consumption (in $\mu$g Hg) of various parts of discharge lamps (SL 18 W) with and without a transparent layer.

| Part of discharge vessel | without transparent layer | Provided with known $Y_2O_3$ transparent layer | Provided with transparent layer according to the invention |
|---|---|---|---|
| 31 | 50.0 | 11.4 | 3.8 |
| 33 | 35.5 | 9.2 | 3.7 |
| 35 | 35.0 | 8.7 | 4.3 |
| 37 | 30.0 | 9.8 | 5.1 |
| 32 | 82 | 51 | 22 |
| 34 | 75 | 42 | 17 |
| 36 | 83 | 50 | 27 |

Table III shows that the mercury consumption is considerably lower in both the straight parts 31, 33, 35, 37 and the bent parts 32, 34, 36 of the discharge vessel than in discharge lamps without a transparent layer or in known discharge lamps. Roughly, the mercury consumption is improved by a factor of two, ranging from a discharge lamp without a transparent layer to a discharge lamp provided with the known $Y_2O_3$ transparent layer, and the mercury consumption further improves by another factor of two, ranging from a discharge lamp provided with the known $Y_2O_3$ transparent layer to a discharge lamp provided with a transparent layer according to the invention. Due to the measure according to the invention, the mercury consumption in, notably, the bent parts 32, 34, 36 of the discharge vessel is improved considerably. The latter is notably the case when using relatively thick transparent layers because the discharge vessel is stretched by approximately 30% during bending, so that the transparent layer is thinner at the bent parts 32, 34, 36 than at the straight parts 31, 33, 35, 37 of the discharge vessel. It is to be noted that the color point of the low-pressure mercury vapor discharge lamp provided with transparent layers according to the invention satisfies the customary requirements ($x \approx 0.31$, $y \approx 0.32$).

It will be evident that many variations within the scope of the invention can be conceived by those skilled in the art.

The scope of the invention is not limited to the embodiments. The invention resides in each new characteristic feature and each combination of novel characteristic features. Any reference signs do not limit the scope of the claims. The word "comprising" does not exclude the presence of other elements or steps than those listed in a claim. Use of the word "a" or "an" preceding an element does not exclude the presence of a plurality of such elements.

What is claimed is:

1. A low-pressure mercury vapor discharge lamp comprising a discharge vessel, said discharge vessel enclosing, in a gastight manner, a discharge space provided with a filling of mercury and a rare gas, a transparent layer on at least a part of an inner wall of the discharge vessel, said transparent layer comprising an oxide of scandium, yttrium or a rare earth metal, and a borate and/or a phosphate of an alkaline earth metal and/or of scandium, yttrium or other rare earth metal.

2. A low-pressure mercury vapor discharge lamp as claimed in claim 1, wherein the alkaline earth metal is calcium, strontium and/or barium.

3. A low-pressure mercury vapor discharge lamp as claimed in claim 1, wherein the other rare earth metal is lanthanum, cerium and/or gadolinium.

4. A low-pressure mercury vapor discharge lamp as claimed in claim 2, wherein the oxide is yttrium oxide and/or gadolinium oxide.

5. A low-pressure mercury vapor discharge lamp as claimed in claim 1 wherein the transparent layer has a thickness of between 5 nm and 200 nm.

6. A low-pressure mercury vapor discharge lamp as claimed in claim 1 wherein the transparent layer has a side facing the discharge space which is provided with a layer of a luminescent material.

7. A low-pressure mercury vapor discharge lamp as claimed in claim 6, wherein the luminescent material comprises a mixture of green-luminescing, terbium-activated cerium magnesium aluminate, blue-luminescing barium magnesium aluminate activated by bivalent europium, and red-luminescing yttrium oxide activated by trivalent europium.

8. A low-pressure mercury vapor discharge lamp as claimed in claim 1 wherein the transparent layer has a thickness configured to reflect light at 254 nm wavelength.

9. A low-pressure mercury vapor discharge lamp comprising a discharge vessel, said discharge vessel enclosing, in a gastight manner, a discharge space provided with a filling of mercury and a rare gas, at least a part of an inner wall of the discharge vessel being in physical contact with a transparent layer, said transparent layer comprising an oxide of scandium, yttrium or a rare earth metal, and a borate and/or a phosphate of an alkaline earth metal and/or of scandium, yttrium or a further rare earth metal.

10. A low-pressure mercury vapor discharge lamp comprising a discharge vessel, said discharge vessel enclosing, in a gastight manner, a discharge space provided with a filling of mercury and a rare gas, a transparent layer on at least a part of an inner wall of the discharge vessel, said transparent layer comprising an oxide of scandium, yttrium or a rare earth metal, and a borate and/or a phosphate of scandium, yttrium, lanthanum, cerium or gadolinium, and the transparent layer having a side facing the discharge space and a layer of a luminescent material on said side.

11. A low pressure mercury vapor discharge lamp of claim 10, wherein the transparent layer has a thickness configured to reflect light at 254 nm wavelength.

* * * * *